United States Patent [19]

Gailey et al.

[11] Patent Number: 4,991,370

[45] Date of Patent: Feb. 12, 1991

[54] SECURITY PANEL SYSTEM

[75] Inventors: J. Lynn Gailey, Clover, S.C.; Thomas O. Johnstone, Cortland, Ohio

[73] Assignee: Alcan Aluminum Corporation, Cleveland, Ohio

[21] Appl. No.: 295,824

[22] Filed: Jan. 11, 1989

[51] Int. Cl.[5] ..... E04B 5/52

[52] U.S. Cl. ..... 52/484; 52/488

[58] Field of Search ..... 52/483, 484, 588, 144, 52/145, 488, 476, 474, 235

[56] References Cited

U.S. PATENT DOCUMENTS

| | | | |
|---|---|---|---|
| 980,255 | 1/1911 | Herms et al. | 52/459 |
| 1,992,054 | 2/1935 | Brown et al. | 52/484 |
| 2,050,503 | 8/1936 | Ray | 52/459 |
| 2,059,483 | 11/1936 | Parsons | 52/404 |
| 3,977,144 | 8/1976 | Jahn | 52/664 |
| 4,155,206 | 5/1979 | Player | 52/200 |
| 4,269,012 | 5/1981 | Mattingly et al. | 52/394 |
| 4,271,653 | 6/1981 | Buchhorn | 52/522 |
| 4,283,897 | 8/1981 | Thompson | 52/489 |
| 4,484,428 | 11/1984 | Sauer | 52/484 |
| 4,694,628 | 9/1987 | Vondergoltz et al. | 52/528 |

FOREIGN PATENT DOCUMENTS

| | | | |
|---|---|---|---|
| 2409028 | 4/1975 | Fed. Rep. of Germany | 52/235 |
| 2152096 | 7/1985 | United Kingdom | 52/474 |

*Primary Examiner*—James L. Ridgill, Jr.

*Attorney, Agent, or Firm*—Cooper & Dunham

[57] ABSTRACT

A security panel system which may be assembled into security panels, having at least one pan member with interlockable ribs for formation of continuous, interlocking pan surface, at least one channel member having a web, a first flange and a second flange having at least one notch for passage of pan ribs therethrough for attachable abutment of the pan ribs against the first flange and at least one trim member attachable to the channel member, for placement against the pan member so that the pan member is captured between the channel member and the trim member. A pair of channel members may be combined along their webs to form a carrier member having pairs of first and second flanges that are oriented opposite each other.

14 Claims, 3 Drawing Sheets

SECURITY PANEL SYSTEM

BACKGROUND OF THE INVENTION

The present invention is directed to building panels and particularly, wall and ceiling security panels for prison cells and the like.

Exploding prison populations require new jails to house prisoners during their detention. Governments have a great need for cost-effective prison cell structures that can be constructed rapidly at minimum cost to taxpayers. Accordingly, there is a great need for security panel systems with components that can be assembled in a variety of configurations to suit architectural layouts of prison buildings. The security panels must have sufficient strength to resist physical impact with no unreinforced, exposed edges that can be pried free by prisoners.

Though not particularly directed to security panel applications, there have been prior designs of building construction panels for use as interior or exterior walls and ceilings, though none of them appear to be suitable for use in construction of prison cells or other security panels in detention facilities.

U.S. Pat. Nos. 1,922,054; 2,059,483; 3,977,144; and 4,484,428 concern suspended ceiling structures having panels retained in structural grids, particularly for interior decoration. Patents for roofing panels having interlocking edges include U.S. Pat. Nos. 4,155,206; 4,269,012; 4,271,653 and 4,694,628. U.S. Pat. No. 980,255 is directed to a greenhouse structure, wherein glass panels are clamped between greenhouse sash bars and drip troughs by wing nuts.

U.S. Pat. No. 2,050,503 shows a sectional wall panel having a pair of edges that are bolted to the edges of a next contiguous sheet. The remaining two panel edges are clamped between a clamping member and a stud. As can be appreciated by one skilled in the art, a strong impact blow to the center of one of the panels shown in the '503 Patent can pop the panel from under the clamping member edges.

It is an object of the present invention to create a security panel system so that security panels, such as walls and ceilings of prison cells can be constructed quickly and cheaply from kits of standard size components.

It is another object of the present invention to create a security panel system having a minimum number of standard size components for construction of security panels, to minimize inventories of different types of components and reduce inventory overhead for manufacturers, distributors and purchasers of the components.

It is an additional object of the present invention to create security panel system components that can be easily and inexpensively fabricated.

It is yet another object of the present invention to create a security panel system that can be constructed into relatively strong security panels, capable of resisting forceful impacts while maintaining structural integrity.

SUMMARY OF THE INVENTION

The foregoing objects have been attained by the security panel system of the present invention, which has a minimum number of structural components that can be quickly and inexpensively constructed into security panels, such as walls and ceilings of prison cells of any desired size and configuration in detention facilities. The individual components included in the security panel system are of relatively simple construction and can be fabricated by high-speed automation, in order to minimize manufacturing costs. Additionally and most importantly, the security panel system components can be constructed into strong panels that can resist forceful impacts while maintaining structural integrity of the security panel.

The present invention is directed to a security panel system which features at least one pan member having a generally flat surface with first and second faces, a pair of ends and a pair of generally parallel longitudinal sides each with a rib projecting from the flat surface, the ribs interlockable with ribs of other pan members placed adjacent thereto for formation of a continuous interlocked surface. The security panel system also features at least one channel member having a web, a first flange and a second flange with at least one notch therein for passage of pan ribs through the second flange, so that the ribs may be abutted against the first flange and attached thereto when the first face along one pan end is aligned in generally parallel abutting contact with the second flange. The security panel system also has at least one trim member attachable to the channel member, for placement against the second face of the pan member over the channel member second flange, so that the pan member is captured between the channel member and the trim member.

The present invention is also directed to a security panel system which features at least one pan member having a generally flat surface with first and second faces, a pair of ends and a pair of generally parallel longitudinal sides each with a rib projecting from the flat surface, the ribs interlockable with ribs of other pan members placed adjacent thereto for formation of a continuous interlocked surface. The security panel system also has at least one pair of channel members each having a web with an offset portion, a first flange and a second flange with at least one notch for passage of pan ribs through the second flange so that the ribs may be abutted against the first flange and attached thereto when the first face along one panel end is aligned in generally parallel abutting contact with the second flange; the pair of channel members alignable in a back-to-back abutting relationship so that each of the pairs of first and second flanges are oriented opposite each other and the offset portions form a recess between the channel member second flanges. This security panel system also features at least one trim member attachable to at least one channel member, having a generally tee-shaped cross-section with three legs, a generally perpendicular leg for placement into the recess formed by the pair of channel members and a pair of opposed, generally parallel legs for contact with pan member second faces, so that the pan member is captured between the channel member and the trim member.

The present invention also includes security panels constructed of the security panel system components of the present invention and kits having component parts of the security panel system of the present invention which are capable of being assembled into security panels.

DESCRIPTION OF THE FIGURES

The present invention may be more readily understood by reference to the figures, which form a part of this specification.

DESCRIPTION OF THE PREFERRED EMBODIMENTS OF THE INVENTION

The following examples are illustrative of the security panel system of the present invention but they are in no way intended to restrict the scope of the claims hereto.

Figure 1:
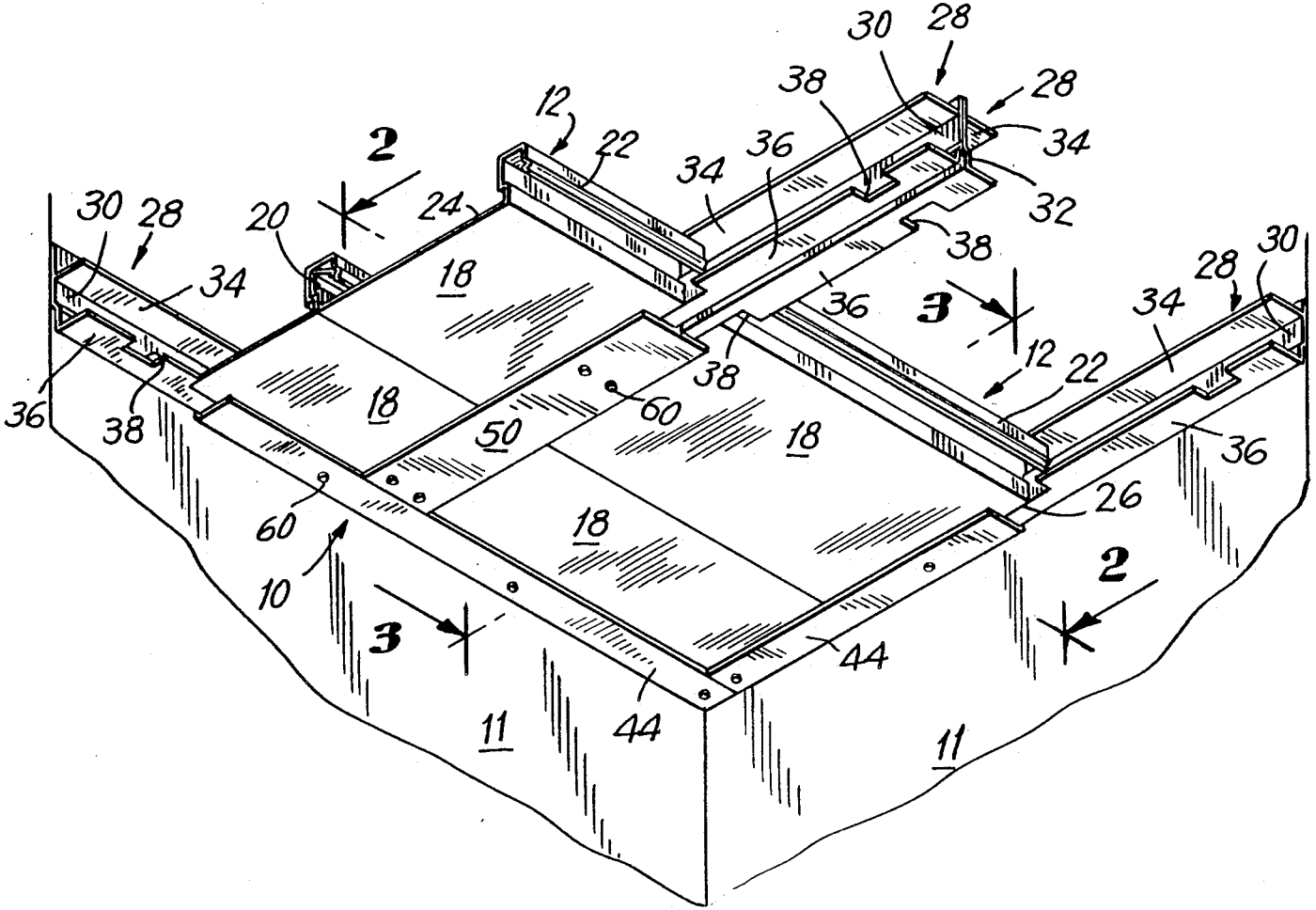
FIG. 1 is a bottom perspective view of a partially constructed security panel of the present invention, which is shown as a ceiling structure.

Referring generally to FIG. 1, there is shown the components of the security panel system of the present invention being used to form a security panel 10. For illustrative purposes, the security panel 10 is shown as a ceiling being constructed between walls 11. A plurality of panels may be combined to form walls, floors and ceilings of structures, such as detention cells, though the assembled panel structures may be used to form other types of building structures.

Figure 2:
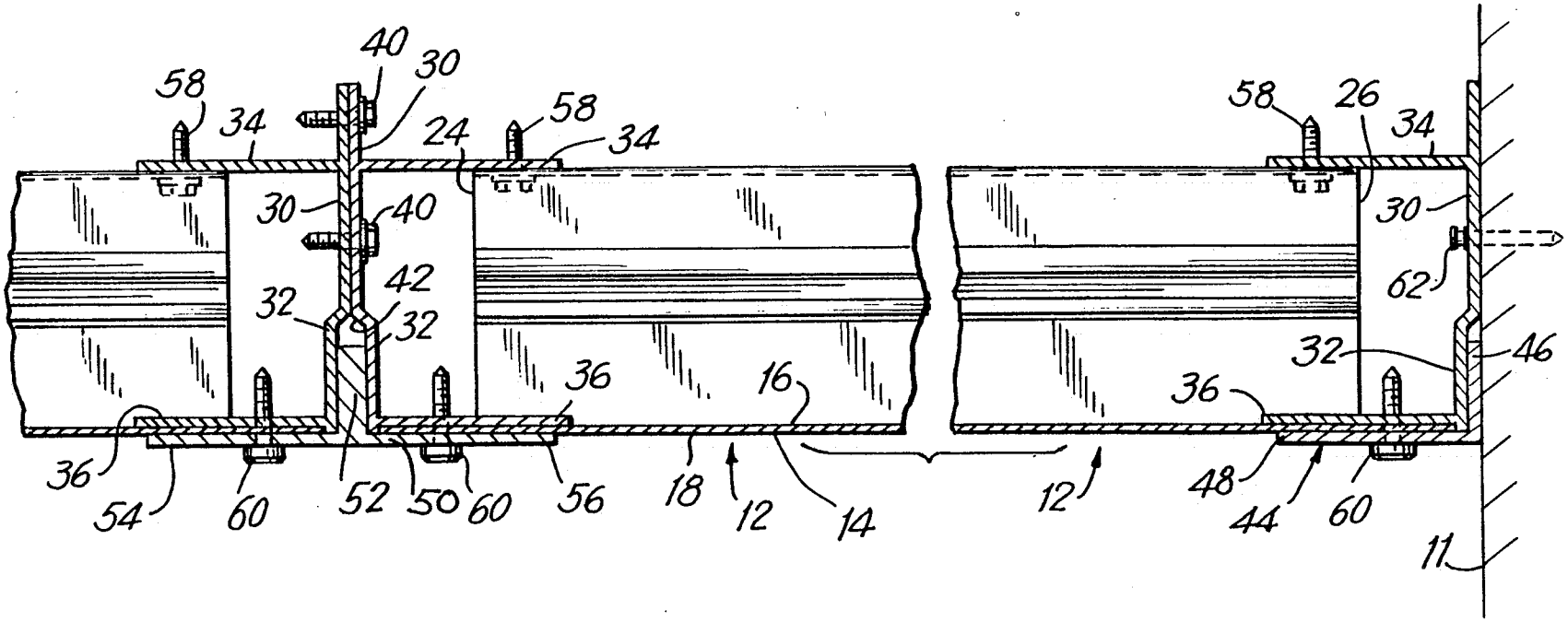
FIG. 2 is a cross-sectional view of the security panel system taken through 2—2 of FIG. 1.
Figure 3:
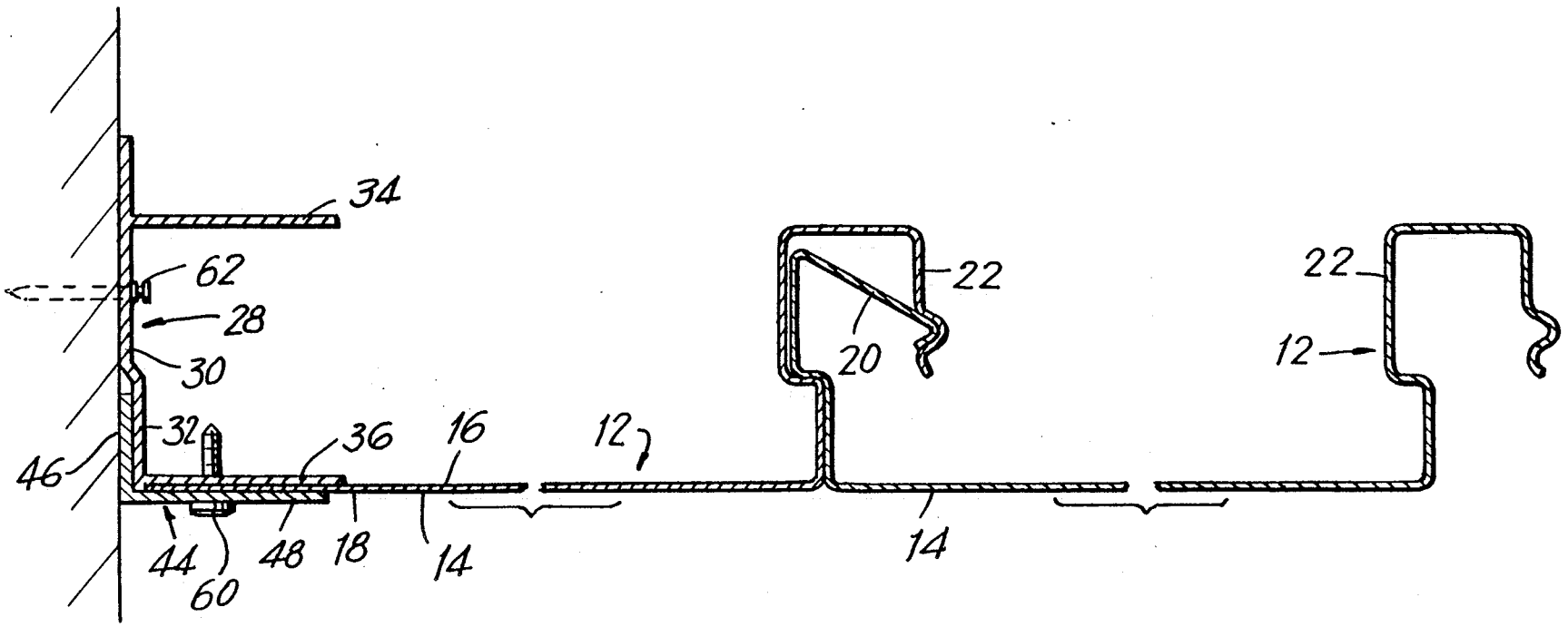
FIG. 3 is a cross-sectional view of the security panel system taken through 3—3 of FIG. 1.

As shown in FIGS. 1-3, the security panel 10 is formed of security panel system components including pan members 12 having generally flat surfaces 14, including a first face 16 and a second face 18. The pan member 12 has interlockable ribs 20 and 22 on opposite sides of the pan. As shown, the ribs 20 and 22 can interlock by snapping two pan members 12 together or by sliding the pans laterally relative to each other so that the rib 20 slidably inserts into rib 22. The ribs 20 and 22 allow a quick and convenient method to afix together a plurality of pan members 12 in side-by-side fashion without the need for separate fasteners and they also impart great stiffness to the assembled pan members 12 along the adjoining seams. Impact pressure along seams between adjoining pan members is absorbed by the ribs 20, 22, which also resist separation or permanent deformation of the adjacent pans. When one of the pan sides is placed against the wall 11, the rib is removed from that side, as shown on the left-most pan in FIG. 3.

The pan members 12 also have ends 24 and 26, which are shown as plain, flush, unreinforced metal edges. While for the sake of illustration, the pan members 12 are shown as having a rectangular shape, other geometric shapes may be employed, such as squares or hexagonal structures. In a hexagonal configuration the pan members would have a pair of generally parallel, interlocking rib structures on opposite sides of the pan member and the ends would be constructed of triangular configuration. By way of example, hexagonal pan members could conceivably be combined to form a geodesic dome.

The security panel system of the present invention also includes channel members 28 which have a web 30. The web 30 may desirably include a web offset 32, use of which will be described in greater detail in a portion of this specification which follows. Channel member 28 also has a first flange 34 and a second flange 36. The second flange includes one or more notches 38. As shown in FIGS. 1 and 2, a pair of channel members 28 may be combined by abutting web portions in back-to-back fashion to form a combined carrier member, having opposed pairs of first and second flanges.

As shown in FIGS. 1 and 2, the carrier member allows joinder of adjacent rows of pan members 12. A carrier member may also be formed from a single channel member having integral opposed pairs of first and second flanges, such as by an extrusion formation process. However, a less expensive and simpler method of carrier member construction, which minimizes the number of components in the security panel system, is to combine separate channel members along their webs in abutting back-to-back configuration, as shown in FIG. 2, by use of any convenient fastener, such as sheet metal screws 40, pop rivets, or spot welds. As one skilled in the art can appreciate, carrier members can be fabricated from channel members by the manufacturer of the security panel system components or at the job site by tradesmen.

As shown in FIG. 2, when the carrier member is formed from a pair of opposed channel members 28, the web offsets 32 of each channel forms a recess 42. In a single-piece carrier member fabrication, the recess would be formed between the pair of second flanges.

The security panel system also includes trim members for capturing the pan member ends 24 and 26 between the channel member second flange 36 and the trim member. The simplest form of trim member can be a flat metal plate fastened to the channel member second flange 36, but such a construction is susceptible to shearing forces against the fastener. Preferred constructions of the trim member include a leg member for insertion into the carrier member recess 42 or, if the channel member 28 is fastened against the side of a wall as shown in FIG. 3, the leg is inserted between the channel member web offset 32 and the wall 11.

As shown in FIG. 3, one type of trim member 44 has an L-shaped cross-section having a first leg 46 that is placed against the channel member web offset 32 and a second leg 48 that is placed against second face 18 of the pan member 12, so that the pan member is captured between the channel member second flange 36 and the second leg 48.

Another type of trim member 50 has a tee cross-sectional shape having a perpendicular leg 52 that is inserted in a carrier member recess 42 (formed by two channel members 28, as shown). The tee-shaped trim member 50 also has an opposed pair of parallel legs 54, 56, each for placement over a pan member second face.

Also as shown in FIG. 2, fasteners 58 may be used to attach rib 22 to the channel member first flange 34 and provide additional structural reinforcement to the security panel. Impact loads to the pan members 12 are distributed to a number of impact points on the channel members, including the first and second flanges, thereby increasing the panel's structural regidity and preventing the pan members 12 from popping out between the channel members and the trim members.

As shown in FIGS. 1 and 2, fasteners 60 attach the trim members 44 and 50 to the channel members 28. Any form of desired fastener known to those skilled in the art may be used, however sheet metal screws with tamper-proof heads are a preferred type of fastener for exposed surfaces As shown in FIGS. 1-3, fasteners 62 attach the channel member 28 to the wall 11.

The security panel system components may be assembled in any configuration to form security panels as desired by architects, licensed engineers or other professionals in the art. One method of assembly, for example to form a ceiling, is to install channel members 28 along walls and combine other channel members into carrier members that are spaced along the ceiling in correspondence with the pan member 12 length. One pan member is inserted through notches 38 of the channel member second flange 36 and the rib 22 is then fastened to the first flange 34. The ribs of the next corresponding pa member are then locked into the previously installed pan member ad seriatim, until a row of interlocked pan members is completed. Next, the trim members 44, 50 are fastened to the channel members 28, thereby capturing pan members 12 between the channel members and the trim members.

Those skilled in the art can also appreciate that some features of the invention as described and shown herein may be incorporated into a security panel system without departing from the scope of the present invention.

What is claimed is:

1. A security panel system comprising:

at least one pan member having a generally flat surface with first and second faces, a pair of ends, and a pair of generally parallel longitudinal sides each with a rib projecting from the flat surface, the rib projecting from the first of the pair of sides, being adapted to interlock with the rib projecting from the second of the pair of sides of an adjacent pan member, so that the generally flat surfaces of the adjacent pans lie in a plane and the second faces of the pan members form a flat surface and first faces of the adjacent pan members form a flat surface bisected by an interlocked pair of ribs projecting from the surface;

at least one channel member having a web, a first flange adapted for attachment to the pan ribs and a second flange adapted for abutting the first face of the pan member along a substantial portion of one end of the pan member, the second flange having at least one notch adapted to permit passage of the pan ribs through the second flange when the end of the pan is positioned adjacent the side of the web closer to the web than the distal edge of the second flange, so that the distal end of the ribs may be abutted against the first flange and attached thereto when the first face along one pan end is aligned in generally parallel abutting contact with the second flange; and at least one trim member for placement against the second face of the pan member over the channel member second flange, so that the generally flat surface of the pan member is captured between the channel member and the trim member.

2. A security panel formed with the components of the security panel system claim 1.

3. A kit having component parts of the security panel system of claim 1, capable of being assembled into a security panel.

4. The security panel system of claim 1, wherein at least one channel member has pairs of first and second flanges on opposite sides of the web.

5. The security panel system of claim 4, wherein the channel member has a recess between the pair of second flanges.

6. The security panel system of claim 5, wherein the trim member has a tee-shaped cross-section with three legs; a perpendicular leg for placement into the channel member recess and a pair of opposed, parallel legs for contact with pan member second faces.

7. The security panel system of claim 1, wherein the channel member web has an offset portion.

8. The security panel system of claim 7, wherein the trim member has a first leg for placement against the second face of the pan member.

9. The security panel system of claim 8, wherein at least one pan member rib is attached to the channel member first flange.

10. A security panel system comprising:

at least one pan member having a generally flat surface with first and second faces, a pair of ends, and a pair of generally parallel longitudinal sides each with a rib projecting from the flat surface, the rib projecting from the first of the pair of sides being adapted to interlock with the rib projecting from the second of the pair of sides of an adjacent pan member so that the generally flat surfaces of the adjacent pans lie in a plane and the second faces of the pan members form a flat surface and first faces of the adjacent pan members form a flat surface bisected by an interlocked pair of ribs projecting from the surface;

at least one pair of channel members each having a web with an offset portion, a first flange adapted for attachment to the pan ribs and a second flange adapted for abutting the first face of the pan member along a substantial portion of one end of the pan member, the second flange having at least one notch therein adapted to permit passage of the pan ribs through the second flange when the end of the pan is positioned adjacent the side of the web closer to the web than the distal edge of the second flange, so that the distal end of the ribs may be abutted against the first flange and attached thereto when the first face along one pan end is aligned in generally parallel abutting contact with the second flange; the pair of channel members alignable in a back-to-back abutting relationship so that each of the pairs of first and second flanges are oriented opposite each other and the offset portions form a recess between the channel member second flanges; and at least one trim member having a generally tee-shaped cross-section with three legs, a generally perpendicular leg for placement into the recess formed by the pair of channel members and a pair of opposed, generally parallel legs for placement against the second faces of the pan members over the abutting channel member second flanges, so that the generally flat surface of the pan members are captured between the abutting channel members and the trim member parallel legs.

11. The security of panel system of claim 10, wherein the pair of back-to-back channel members are attached to each other.

12. The security panel system of claim 10, wherein at least one pan member rib is attached to the channel member first flange.

13. A security panel formed with components of the security panel system of claim 10.

14. A kit having component parts of the security panel system of claim 10, capable of being assembled into a security panel.

* * * * *